US007469442B1

(12) United States Patent
Matheson

(10) Patent No.: US 7,469,442 B1
(45) Date of Patent: Dec. 30, 2008

(54) SCRUBBER WITH REMOVABLE WASHING ELEMENT

(76) Inventor: Justin W. Matheson, 2900 E. 6th, #44, Stillwater, OK (US) 74074

( * ) Notice: Subject to any disclaimer, the term of this patent is extended or adjusted under 35 U.S.C. 154(b) by 575 days.

(21) Appl. No.: 10/825,998

(22) Filed: Apr. 15, 2004

(51) Int. Cl.
*A47K 7/02* (2006.01)

(52) U.S. Cl. ..... 15/209.1; 15/229.13

(58) Field of Classification Search ..... 15/209.1, 15/210.1, 159.1, 160, 229.13, 110, 244.1, 15/244.2, 244.3, 244.4, 208, 229.11, 247
See application file for complete search history.

(56) References Cited

U.S. PATENT DOCUMENTS

| | | | | | |
|---|---|---|---|---|---|
| D156,039 | S | * | 11/1949 | Sabo | D32/51 |
| 3,571,837 | A | * | 3/1971 | Weaver | 15/231 |
| 4,184,221 | A | | 1/1980 | Edwards | |
| 5,182,838 | A | * | 2/1993 | Stenner | 24/712.7 |
| 5,809,607 | A | | 9/1998 | Elson et al. | |
| 5,875,511 | A | | 3/1999 | Nejdl | |
| 6,276,022 | B1 | | 8/2001 | Gallacher | |
| 6,370,723 | B1 | | 4/2002 | Chang | |
| 6,438,787 | B1 | | 8/2002 | Young | |
| 6,453,503 | B1 | * | 9/2002 | Chen | 15/209.1 |
| 6,510,577 | B1 | * | 1/2003 | Borcherds et al. | 15/118 |
| 6,557,204 | B2 | | 5/2003 | Maxwell | |
| 6,689,224 | B1 | * | 2/2004 | Hillman | 134/6 |

* cited by examiner

*Primary Examiner*—Laura C Guidotti

(57) ABSTRACT

There is provided herein a tool to assist a user in applying a scrubbing device such as a sponge to a surface that is to be cleaned. In the preferred arrangement, the instant device will consist of two components: a detachable scrubber and an elongate handle. The scrubber portion of the instant invention will preferably be a sponge, mesh ball, or similar porous and permeable material. Attached to the sponge will be a string, ribbon, stand of elastic or other attaching member suitable for engagement with the structure of the handle. The handle will have a longitudinal slit at one end through which the attaching member will pass before being secured on the reverse face of the handle by another slit or via a mechanical structure.

19 Claims, 3 Drawing Sheets

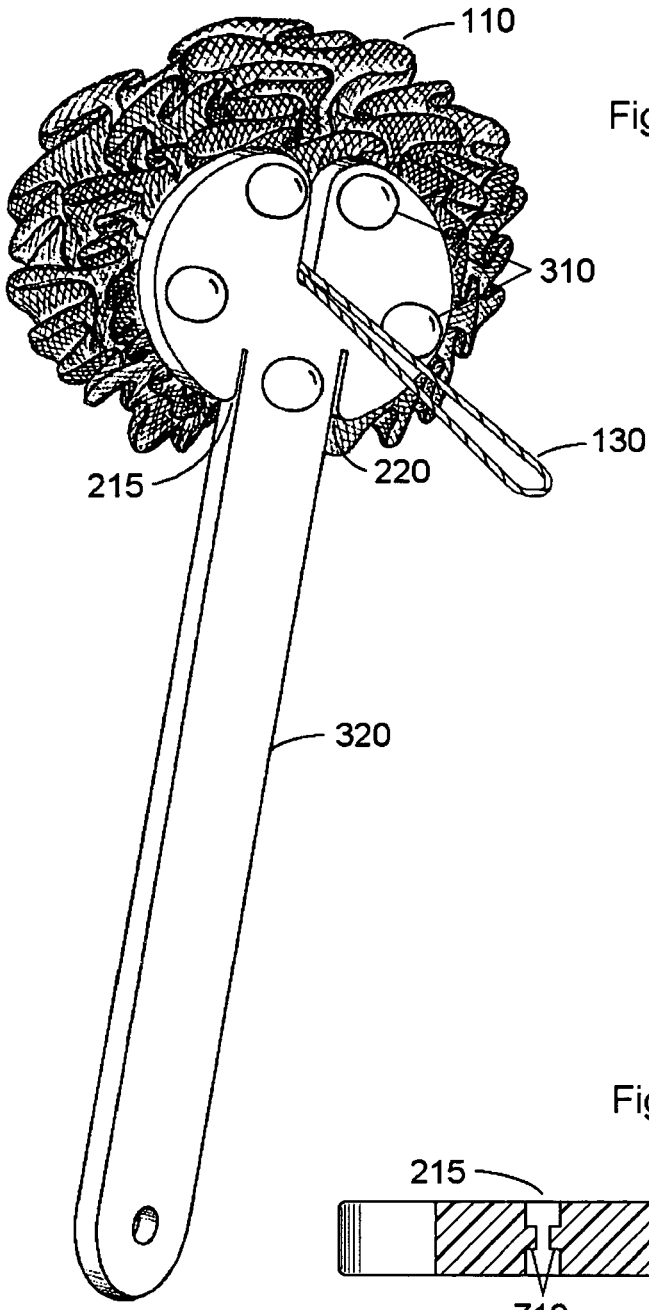
Figure 3
Figure 7
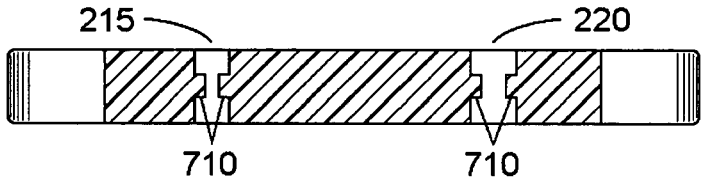

SCRUBBER WITH REMOVABLE WASHING ELEMENT

FIELD OF THE INVENTION

The present invention relates generally to sponge or pouf holders for use in bathing, dishwashing, and the like.

BACKGROUND OF THE INVENTION

The problem of applying soap to surfaces is, of course, a venerable one. Whether such an application is for purposes of dishwashing, bathing, etc., experience has shown that a sponge, mesh ball, or similar flexible porous and permeable material is nearly ideal for cleansing in any number of different situations.

However, after applying soap to the sponge or other scrubbing device the user is immediately confronted with the problem of applying the soapy sponge to the area that is to be cleaned. In some instances (e.g., the exterior of a pot) reaching the area that is to be cleaned is not a problem. In other cases, though, applying the sponge to the surface that is to be cleaned poses certain difficulties.

In some cases the surface that is intended to be scrubbed may not be readily accessible by a human hand. For example, if the user desires to wash within a bottle or jar, its narrow mouth may preclude direct application of the sponge. As another example, if the user of the sponge is intending to use it for purposes of personal hygiene (e.g., during a bath or shower) it can often be difficult to apply it unassisted to some portions of a person's body (e.g., hard to reach areas such as the user's back).

Another difficulty that can arise in connection with the use of a conventional sponge is that in some stances the water or other cleansing solution may be too hot or caustic to allow the user to submerge the sponge therein using his or her hand. In such a case gloves may be advisable or necessary, but that often requires the user to stop the cleaning activity and search for suitable hand protection before proceeding with the task at hand.

Others who have recognized these and other similar problems, have devised attachments for use with a sponge that help address some of the aforementioned problems. See, for example, Maxwell, U.S. Pat. No. 6,557,204, who teaches the use of a complex scrubbing device with a removable head. However, such solutions tend to be overly complex and the process of attaching and removing the scrubbing device only delays further the completion of the targeted task. Further, such inventions may make it difficult to remove the attached sponge for cleaning or disposal.

Thus, what is needed is a device for manipulating a sponge or other scrubbing implement that is designed to address and the aforementioned problems. Such a device would preferably assist a user in reaching and cleaning hard-to-reach locations and would feature a removable cleaning element that can be readily attached and detached.

Heretofore, as is well known in the media editing industry, there has been a need for an invention to address and solve the above-described problems. Accordingly it should now be recognized, as was recognized by the present inventors, that there exists, and has existed for some time, a very real need for a system and method that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of the invention within the ambit of the appended claims.

SUMMARY OF THE INVENTION

There is provided herein a tool to assist a user in applying a scrubbing device such as a sponge or mesh pouf to a surface that is to be cleaned. In the preferred arrangement, the instant device will consist of two components: a detachable scrubber and an elongate handle. The scrubber portion of the instant invention will preferably be a sponge, mesh ball, or similar porous and permeable material. Attached to the sponge will be a string, ribbon, stand of elastic or other attaching member suitable for engagement with the structure of the handle as described hereinafter.

The handle portion will preferably be elongated and will contain a region that is suitable for gripping by the user. This portion of the handle might be textured or contoured to increase the user's ability to grasp it.

The end opposite from the gripping region will preferably terminate in a roughly circular or heart-shaped/cordate end piece which contains a centrally aligned longitudinal slit therein. The slit is for receiving the attaching string of the scrubbing device. Additionally and according to a first preferred arrangement, there will be provided at least one, but preferably two, additional longitudinal slits at the shoulders of the circular terminus. One preferred use for these additional longitudinal slits is to help affix the scrubbing element to the handle via its attaching member, wherein the attaching member is first threaded through the centrally aligned longitudinal slit and thereafter engaged with or both of the retaining slits. Preferably, the slits will be of different widths to accommodate strings of varying sizes, although this is not a requirement.

According to another preferred embodiment, there is provided a tool for cleaning substantially as described above, but wherein instead of one or more longitudinal slits in the shoulders of the end piece, other mechanisms for provided for securing the sponge to the handle. In brief, each secures the attaching string from the sponge after it passes through the central longitudinal slit in a slightly different manner. For example, in one preferred embodiment a clip will be provided under which the terminus of the attaching string opposite the sponge might be slipped, thereby securing it and the sponge to the handle. In other preferred arrangements, a hook, latch, peg, ratchet, clamp, wedge, etc., are used to secure the lose end of the attaching string so that the sponge stays in place on the handle.

According to still another preferred embodiment, there is provided a scrubbing device substantially as described above, but wherein the rearward face of the handle contains an exfoliation pad and/or one or more massage bosses.

According to another preferred embodiments there is provided a scrubbing device substantially as described above, but wherein the retaining slits are enhanced by providing including rubber inserts that are designed to grip the string more securely.

In still another preferred arrangement, there is provided a strain relief feature which is located proximate to at least one of the slits, the purpose of which is to provide strain relief when larger strings are used with the scrubbing device.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and ob being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention. Further objects, features and advantages of the present invention will be apparent upon examining the accompanying drawings and upon reading the following description of the preferred embodiments.

BRIEF DESCRIPTION OF THE DRAWINGS

Other objects and advantages of the invention will become apparent upon reading the following detailed description and upon reference to the drawings in which:

FIG. 3 depicts a rearward view of a preferred handle embodiment wherein additionally massage bosses have been added to the rearward face.

FIG. 7 provides a cross sectional view of the embodiment of FIG. 2 which illustrates more clearly the central ridge which preferably runs through the engaging slits.

DESCRIPTION OF THE PREFERRED EMBODIMENTS

Figure 1:
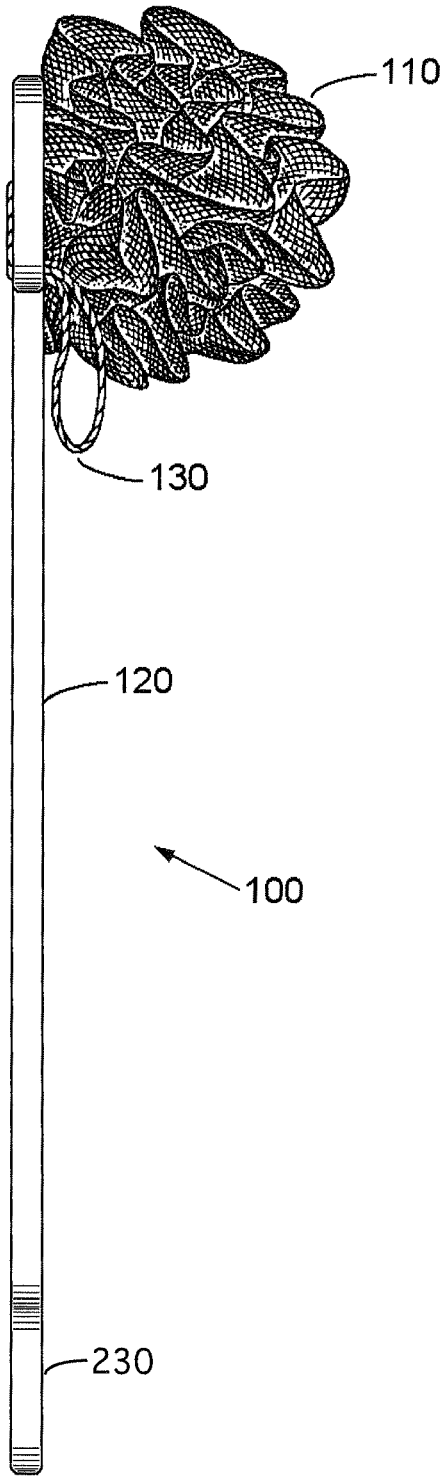
FIG. 1 depicts a side view of the instant invention.
Figure 2:
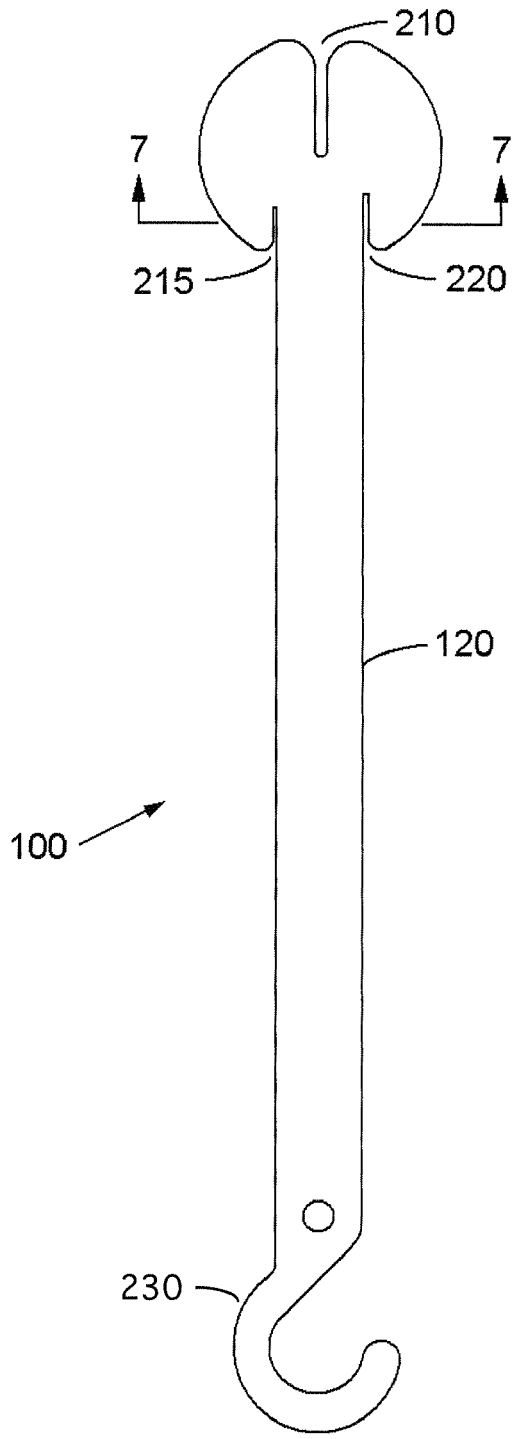
FIG. 2 illustrates a plan view of a preferred handle of the instant invention as it would appear without the scrubbing material attached.

Referring now to the drawings, wherein like reference numerals indicate the same parts throughout the several views, there is provided in FIGS. 1 and 2 a first preferred embodiment of the instant cleaning tool 100 invention. As is indicated in FIG. 1, in a preferred arrangement scrubbing material 110 is removably attached to handle 120 by attaching cord 130 at it's the handle's 120 upper terminus. The scrubbing material 110 might be an artificial or natural sponge, a ball of netting, a soft brush, a washcloth or other bit of fabric, or any other porous and permeable material that would be suitable for use in cleaning. Preferably, this material 110 will have an attaching cord 130 permanently affixed thereto, although those of ordinary skill in the art will recognize that the cord 130 could be made to be removable from the scrubbing material 110 without altering the spirit of the instant invention 100.

FIG. 2 contains a plan view of the handle 120 as it would appear without the attached scrubbing material 110. As can be seen, in one preferred arrangement the upper end of the handle 120 will be flared outward to make the terminus roughly circular in shape. Although this sort of shape is not required, the instant inventor has determined that the flared terminus of the handle 120 provides support when pressure is exerted during washing. That is, when a user presses the scrubbing material 110 against an object to clean it, the flared terminus of the handle 120 provides a solid surface against which the scrubbing material 110 may be compressed, thereby exerting pressure against the surface that is to be cleaned. Further, it is anticipated that in some cases it might be beneficial to make a portion of the face of the handle 120 that contacts the scrubbing material 110 somewhat rough to retard the movement of that material across the face of the handle 120 while it is in use. Although this might be done in many ways, one preferred arrangement would be to apply a rubber-like non-skid coating to the face of the flared portion of the handle. In another preferred arrangement, fabric, roughened plastic, Velcro® hooks, or many other materials might be used. Indeed, the coating might be selected to be sticky or tacky, although continued exposure to cleaning solutions would likely tend to decrease its effectiveness.

Preferably along the central axis of the upper terminus will be a longitudinal slot 210 which penetrates at least part of the way into the terminus of the handle 120. Additionally, in this preferred embodiment will be provided at least one retaining slit 215 and 220, each of which is preferably positioned near a shoulder of the outwardly flaring terminus. The width of slot 210 at its mouth must be sufficient to accommodate the attaching cord 130. Similarly, the openings of retaining slits 215 and 220 must be sufficiently wide to accommodate the attaching cord 130, although each preferably tapers to a width less than that of the attaching cord 130, thereby making it possible to lodge the cord 130 therein and have it held in place by friction. Additionally, and as is generally indicated in FIG. 2, the retaining slits 215 and 220 might be made to be different sizes, to accommodate a range of attaching cord 130 thicknesses.

In one preferred arrangement, at the remote non-flaring end of the handle 120 will preferably be provided a hook 230 which will allow the device 100 to be suspended by hanging (e.g., from a peg or other wall protuberance) during time that it is drying.

In practice and according to the instant embodiment, to quickly assemble the instant invention 100 the user will take the scrubbing material 110 and its attached cord 130 in one hand and the handle 120 in the other. The attaching cord 130 would then be threaded through the longitudinal slot 210 and pulled tight to force the scrubbing material 110 against the face of the terminus of handle 120. See, for example, FIG. 3 which illustrates this operation. Then the cord 130 will preferably be pulled downward (with respect to the orientation of FIG. 2) to tension it and thereafter pulled downward and into one of the retaining slits 215 or 220. Then, if the free end of the cord 130 is pulled upward and deeper into the preferred retaining slit 215 or 220, the decreasing width of the slots will tend to capture the cord 130 and hold it in place by friction, thereby preventing it from being withdrawn while the apparatus 100 is in use. By this preferred mechanism, the scrubbing material 110 may be held in place during actual scrubbing.

Of course, to remove the scrubbing material 110 from the handle 120, the steps described above are simply reversed. That is, the cord 130 is disengaged from the should slit 215/220 and pulled out of the slot 210 and away from the handle 120, thereby lifting the attached the scrubbing material 110 from where it is seated at the handle 120 terminus.

FIG. 3 provides a rear view of another preferred handle of the instant invention, wherein one or more massage bosses 310 have been provided on the rearward face of handle 320.

Such bosses 310 might be made of a material such as plastic or rubber and might be either soft and compressible or hard and incompressible according to the desires of the manufacturer and end user. Those of ordinary skill in the art will recognize that the bosses 310 are useful in a variety of cleaning contexts and especially so when bathing as they provide, for example, a surface which can be used to gently rake the skin of the user's back and/or to massage it. Note that because the scrubbing material 110 can be quickly removed, the bosses 310 could be placed on either (or both) sides of the handle 320.

Figure 4:
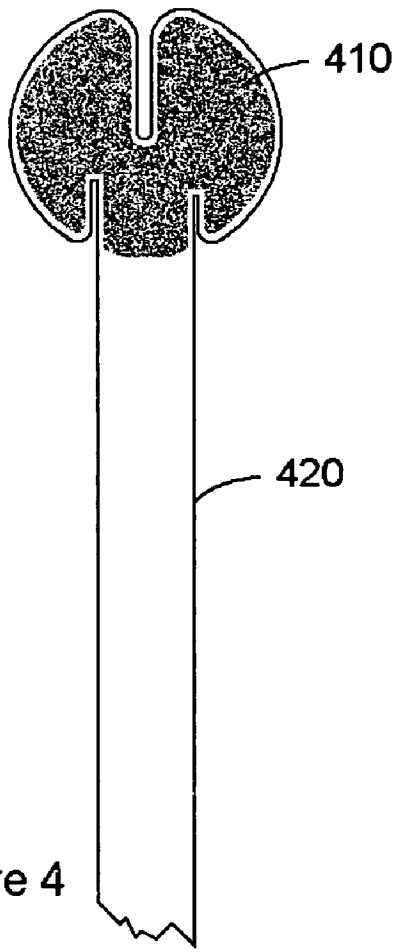
FIG. 4 illustrates still another preferred embodiment wherein an exfoliation or similar scrubbing surface has been added to the rearward face of the handle.

FIG. 4 illustrates another enhancement to the basic invention described herein, where the rearward face of handle 420 has been fitted with an exfoliation pad 410 or a similar preferably mildly abrasive surface. The use of such surfaces for maintenance of a user's skin are well known to those of ordinary skill in the art.

Figure 5:
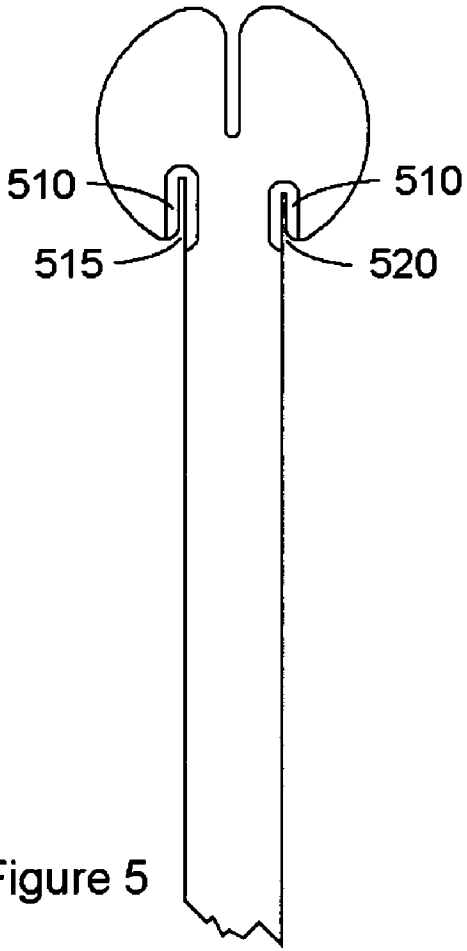
FIG. 5 contains an illustration of a preferred embodiment wherein the retaining slits are lined with rubber or a similar non-skid material.

FIG. 5 illustrates another preferred embodiment, wherein the retaining slits 515 and 520 have been lined with a rubber or a similar non-skid and resiliently compressible material, one purpose of which is to cause the cord 130 to be grasped more securely within the slit. One purpose of these rubber fittings 510 is to allow the cord 130 from the puff to be held more securely after it has been wedged into place.

Figure 6:
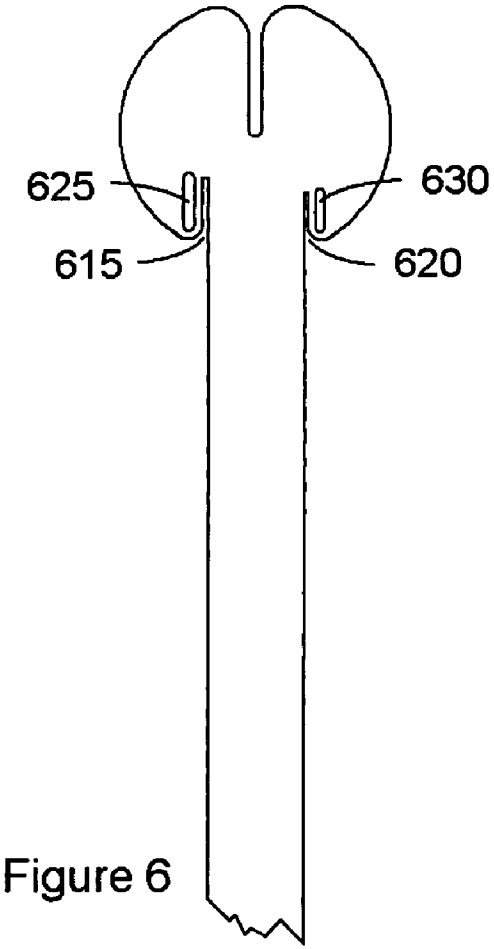
FIG. 6 illustrates another preferred arrangement wherein, in addition to the retaining slits, adjacent strain relief features are provided proximate thereto.

As is generally indicated in FIG. 6, there is provided still another preferred embodiment, wherein the slits 615 and 620 are designed to accommodate larger cords 130, such provision being made by including strain relief members 625 and 630. As should be apparent from this figure, in this preferred arrangement the strain relief members 625 and 630 located proximate to slits 615 and 620 and preferably take the form of apertures through the handle, which apertures might or might not be filled with a compressively resilient material such a rubber. Those of ordinary skill in the art will recognize that such members 615 and 620 might also be left empty. In either case, the proximity of the strain relief member 625 and 630 to the slits 615 and 620 make it possible for the slits to expand somewhat in to the void of the relief members, thereby making it possible to accommodate larger diameter cords 130.

Finally, and as is generally illustrated in FIG. 7, according to still another preferred embodiment, there is provided a feature of the instant invention 100 that is designed to assist a user engage the cord 130 within one or the other of the slits 215 and 220. In one preferred arrangement, on the inner surfaces of one or both of the slits 215 and 220 will be a matching pair of runners/raised central ridges 710 which preferably extend from the upper extent of these two slots toward their external openings. Preferably, each of the central ridges 710 will be tapered on toward its outer termini so make it easier for the cord 130 to slide thereon. A principal reason for the inclusion of such features is to make it easier to slide the cord deeply into the slits 215 and 220. The instant inventor has determined such ridges 710 reduce the amount of friction that is generated between the cord 130 and the walls of the slits 215 and 220 because they reduce the amount of surface area contact between the cord 130 and the slit walls, thereby reducing the amount drag on the cord 130 and the amount of force that is necessary to engage and disengage it from the instant invention 100.

CONCLUSIONS

Of course, many modifications and extensions could be made to the instant invention by those of ordinary skill in the art. For example, the attaching cord 130 might be made of an inelastic material such as twine, string, or even a metal chain, etc., or any number of different elastic materials. Those of ordinary skill in the art will recognize that the choice of the type and properties of attaching cord might be will preferably be made depending on the needs and desires of the user.

Further, although it is preferable that the slot 210 originate at the upper terminus of the handle 120 and be at least roughly parallel to the longitudinal axis of the handle 120, that is not strictly required. Those of ordinary skill in the art will recognize that a variety of different slot 210 orientations are certainly possible. For example, referring for the moment to FIG. 2, in one alternative arrangement, the slot 210 will be horizontally oriented with its opening toward the left side of FIG. 2, with a retaining slit being located, say on the right hand side of side of the handle 120. In such a case, the cord 130 would be fed into the horizontal opening and then hooked into the retaining slit to secure it in a manner that is exactly analogous to that described previously. Obviously, there are any number of other orientations in which the slot 210/retaining slit might be arranged, the only requirement being that the slot 210 and retaining slit should be arranged with sufficient angular separation (preferably at least 90 degrees apart) so that the cord 130 will be securely held by the retaining slit.

Note also that although the slot 210 is preferably a linear feature, that is not its only possible configuration. In some arrangements, the slot 210 might be curved, have a right angle bend in it, or be in some other configuration. Those of ordinary skill in the art will be able to determine when such alternative designs would be beneficial.

Those of ordinary skill in the art will recognize that, although an artificial or natural sponge or a gathering of mesh netting are certainly preferred choices for scrubbing material 110, there are many other materials that could be used in the alternative. All that is required is that the chosen material has at least some effective porosity and permeability as would be desirable in any material that is to be used in cleaning. For example, cloth of almost any sort would be appropriate, as would many porous synthetic materials made of rubber or plastic. A brush would be appropriate as well, but it likely would need to have relatively soft bristles, else the attaching cord 130 might prove to be insufficient to hold it in place.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those skilled in the art, without departing from the spirit of the inventive concept the scope of which is to be determined by the following claims.

What is claimed is:

1. A scrubbing device, comprising:

a. an elongate handle, said handle having an upper end and a lower end, a forward side and a rearward side, and a periphery, wherein at least said lower end is adapted for grasping by a user, said upper end of said handle having a substantially linear elongate slot therein, said slot having a slot opening in said periphery of said handle upper end and said slot being oriented substantially parallel to a center longitudinal axis of said handle, wherein said handle has at least one substantially linear elongate slit therein, said at least one slit being proximate to said slot, being oriented at an angle greater than about 90° with respect to said slot, having a left interior face and a right interior face, wherein said left interior face has a left ridge extending toward an interior of said slit, and wherein said right interior face has a right ridge extending toward said interior of said slit, said left and right ridges being at least approximately in alignment with and opposing each other and providing a surface along with which an attaching cord may engaged when it is within said slit, and, having a slit opening in said periphery of said handle upper end, said slit opening being situated at one end of said slit; and, b. a porous scrubbing material, said scrubbing material having said attaching cord affixed thereto, whereby said attaching cord is adapted to pass through and engage said slot and to pass through and engage one of said at least one slit, thereby removably fastening said scrubbing material to said handle.

2. A scrubbing device according to claim 1, wherein said attaching cord is selected from a group consisting of string, twine, a ribbon, a metal chain, a plastic chain, a rope, and an elastic band.

3. A scrubbing device according to claim 1, wherein said attaching cord is removably attached to said scrubbing material.

4. A scrubbing device according to claim 1, wherein said scrubbing material is selected from a group consisting of a sponge, a mesh netting, a washcloth, and a brush.

5. A scrubbing device according to claim 1, wherein said upper end of said handle is outwardly flared at its terminus.

6. A scrubbing device according to claim 5, wherein at least one of said slit is formed in said upper end of said handle at a shoulder of said outwardly flaring terminus of said handle.

7. A scrubbing device according to claim 1, wherein said at least one slit is oriented to be substantially parallel to said slot.

8. A scrubbing device according to claim 1, wherein there are a plurality of linear elongate slits.

9. A scrubbing device according to claim 8, wherein there are two slit, and wherein each of said two slits has a different width.

10. A scrubbing device according to claim 1, wherein at least one of said at least one slit is lined with a non-skid material.

11. A scrubbing device according to claim 10, wherein said non-skid material is rubber.

12. A scrubbing device according to claim 1, wherein said handle has at least one massage boss thereon.

13. A scrubbing device according to claim 1, wherein at least a portion of said handle is covered with an exfoliation mat.

14. A scrubbing device according to claim 1, wherein said rearward side of said handle has at least one massage boss thereon.

15. A scrubbing tool, comprising:

a. a scrubbing material, said scrubbing material having an attaching cord affixed thereto; and, b. a handle, at least a portion of said handle being adapted for grasping by a user, said handle having at least (1) an upper end, (2) a rearward face, (3) a front face, (4) a periphery, (5) a substantially linear elongate slot placed within said handle within said upper end of said handle and proximate to a terminus thereof, said slot having a terminus that extends to said periphery of said handle, wherein said slot is configured to accommodate said attaching cord of said scrubbing material, and, (6) at least one substantially linear elongate slit placed within said handle proximate to said slot, each of said at least one slit being oriented at an angle of greater than about 90° with respect to said slot, said slit at least for removably engaging said attaching cord after said cord is passed through said slot, said slit having a left interior face and a right interior face, wherein said left interior face has a left ridge extending toward an interior of said slit, and wherein said right interior face has a right ridge extending toward said interior of said slit, said left and right ridges being substantially in alignment with and opposing each other and providing a surface with which an attaching cord may be engaged when it is within said slit, and, said attaching cord urging said scrubbing material against said front face of said handle proximate to said slit when said attaching cord passes through and is engaged with both said slot and one of said at least one slit.

16. A scrubbing device, according to claim 15, wherein said attaching cord is selected from a group consisting of string, twine, a ribbon, a metal chain, a plastic chain, a rope, and an elastic band.

17. A scrubbing device, according to claim 15, wherein said scrubbing material is selected from a group consisting of a sponge, a mesh netting, a washcloth, and a brush.

18. A scrubbing device, according to claim 15, wherein said handle is elongated and said upper end of said handle is outwardly flared at its terminus.

19. A scrubbing device according to claim 15, wherein there are two slits, and wherein each of said two slits has a different width.

* * * * *